US008392054B2

(12) United States Patent
Schneider et al.

(10) Patent No.: US 8,392,054 B2
(45) Date of Patent: Mar. 5, 2013

(54) AUTOMATIC ENGINE OIL LIFE DETERMINATION ADJUSTED FOR VOLUME OF OIL EXPOSED TO A COMBUSTION EVENT

(75) Inventors: Eric W. Schneider, Shelby Township, MI (US); Matthew J. Snider, Howell, MI (US); Robert M. Olree, Troy, MI (US); David R. Staley, Flushing, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 178 days.

(21) Appl. No.: 12/857,660

(22) Filed: Aug. 17, 2010

(65) Prior Publication Data

US 2012/0046823 A1 Feb. 23, 2012

(51) Int. Cl.

| | |
|---|---|
| ***G01M 17/00*** | (2006.01) |
| ***G01N 33/30*** | (2006.01) |
| ***G06F 7/00*** | (2006.01) |
| ***G06F 11/30*** | (2006.01) |
| ***G06F 19/00*** | (2006.01) |
| ***G07C 5/00*** | (2006.01) |

(52) U.S. Cl. ..... 701/29.5; 701/29.1; 701/29.4

(58) Field of Classification Search ..... None
See application file for complete search history.

(56) References Cited

U.S. PATENT DOCUMENTS

| | | | | |
|---|---|---|---|---|
| 6,848,419 | B1 * | 2/2005 | Donaldson | 123/349 |
| 7,509,937 | B2 * | 3/2009 | Hofbauer | 123/196 R |
| 2004/0093150 | A1 * | 5/2004 | Arai et al. | 701/104 |
| 2011/0208385 | A1 * | 8/2011 | Johnson | 701/30 |

* cited by examiner

*Primary Examiner* — Paul Danneman

(74) *Attorney, Agent, or Firm* — Quinn Law Group, PLLC

(57) ABSTRACT

A method is provided for determining remaining oil life prior to an oil change in an internal combustion engine that uses a body of oil. The method includes transferring the body of oil to the engine and determining a volume of the transferred body of oil. The method also includes determining a factor representative of a volume of oil from the transferred body of oil that is exposed to a combustion event in the engine. Additionally, the method includes determining the remaining oil life based on the determined volume of the body of oil and the determined factor representative of a volume of oil that is exposed to a combustion event. Moreover, the method includes activating an oil change indicator when the remaining oil life reaches a predetermined level. A system for determining a number of engine revolutions permitted on a volume of oil is also disclosed.

16 Claims, 2 Drawing Sheets

AUTOMATIC ENGINE OIL LIFE DETERMINATION ADJUSTED FOR VOLUME OF OIL EXPOSED TO A COMBUSTION EVENT

TECHNICAL FIELD

The present invention relates to a system for automatic engine oil life determination adjusted for volume of oil exposed to a combustion event.

BACKGROUND

In internal combustion engines, oil is typically used for lubrication, cleaning, inhibiting corrosion, to improve sealing, and to cool the engine by carrying heat away from the moving parts. Engine oils are generally derived from petroleum-based and non-petroleum synthesized chemical compounds. Modern engine oils are mainly blended by using base oil composed of hydrocarbons and other chemical additives for a variety of specific applications. Over the course of oil's service life, engine oil frequently becomes contaminated with foreign particles and soluble contaminants, and its chemical properties become degraded due to oxidation and nitration. A common effect of such contamination and degradation is that the oil may lose its capability to fully protect the engine, thus necessitating the used oil to be changed or replaced with clean, new oil.

Engine oil is generally changed based on time in service, or based on a distance the engine's host vehicle has traveled. Actual operating conditions of the vehicle and hours of engine operation are some of the more commonly used factors in deciding when to change the engine oil. Time-based intervals account for shorter trips where fewer miles are driven, while building up more contaminants. During such shorter trips, the oil may often not achieve full operating temperature long enough to burn off condensation, excess fuel, and other contamination that may lead to "sludge", "varnish", or other harmful deposits.

To aid with timely oil changes, modern engines often include oil life monitoring systems to estimate the oil's condition based on factors which typically cause degradation, such as engine speed and oil or coolant temperature. When an engine employing an oil life monitoring system is used in a vehicle, such a vehicle's total distance traveled since the last oil change may be an additional factor in deciding on the appropriate time for an oil change.

SUMMARY

A method is disclosed herein for determining remaining oil life prior to an oil change in an internal combustion engine that uses a body of oil. The method includes transferring the body of oil to the engine and determining a volume of the transferred body of oil. The method also includes determining a factor representative of a volume of oil from the transferred body of oil that is exposed to a combustion event in the engine. Additionally, the method includes determining the remaining oil life based on the determined volume of the body of oil and the determined factor representative of a volume of oil that is exposed to a combustion event. Moreover, the method includes activating an oil change indicator when the remaining oil life reaches a predetermined level.

The method may additionally include resetting the oil change indicator to represent 100% of oil life remaining following the oil change. At least one of the acts of determining a volume of the transferred body of oil, determining the remaining oil life, and activating and resetting the oil life indicator may be accomplished via a controller arranged relative to and operatively connected to the engine.

The engine may include an oil sump arranged to accept the transferred body of oil. The act of determining a volume of the transferred body of oil may include determining a level of the transferred body of oil in the sump. The act of determining the remaining oil life may further include determining a number of revolutions for each combustion event of the engine and determining a number of combustion events permitted using the determined volume of oil.

The engine may also include a combustion chamber characterized by a bore diameter. In such a case, the factor representative of a volume of oil from the transferred body of oil that is exposed to a combustion event may be based on the engine's bore diameter.

A system for determining the remaining oil life permitted on a volume of oil is also disclosed.

The above features and advantages and other features and advantages of the present invention are readily apparent from the following detailed description of the best modes for carrying out the invention when taken in connection with the accompanying drawings.

DETAILED DESCRIPTION

Figure 1:
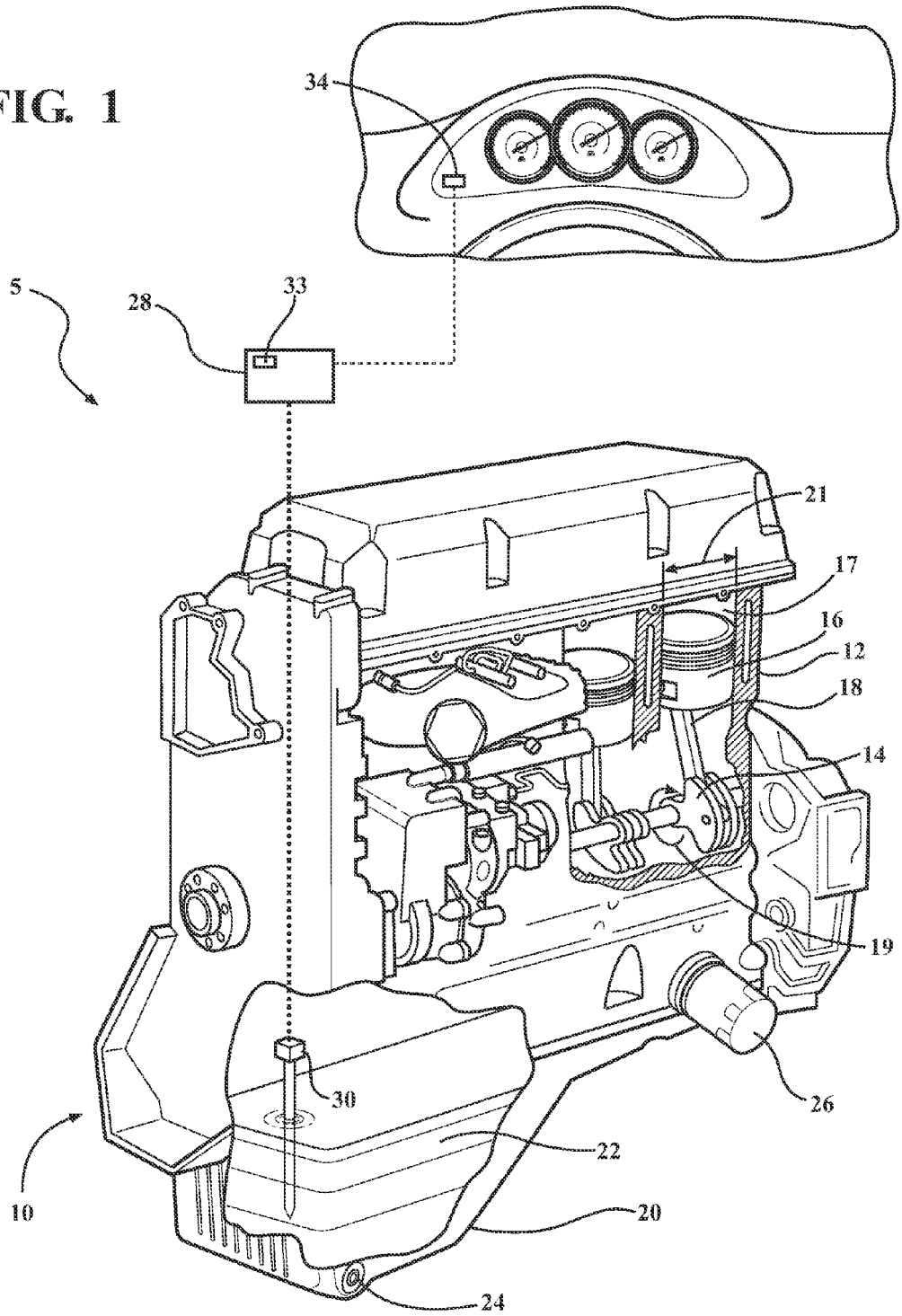
FIG. 1 is a schematic illustration of an engine oil life monitoring system.

Referring to the drawings wherein like reference numbers correspond to like or similar components throughout the several figures, FIG. 1 illustrates an automatic oil life system 5. Oil life system 5 is configured for determining remaining effective or useful life of oil utilized in an internal combustion engine prior to an oil change. The determining of the remaining oil life by oil life system 5 includes determining a number of permitted engine revolutions on a specific volume of oil.

Automatic oil life system 5 includes an internal combustion engine which is represented schematically and denoted by numeral 10. Engine 10 includes an engine block 12. Block 12 houses engine internal components such as a crankshaft 14, reciprocating pistons 16, and connecting rods 18. Pistons 16 are attached to crankshaft 14 via rods 18 to transfer the force of combustion to the crankshaft and thereby rotate the engine 10. Rotation of engine 10, which is typically measured in terms of revolutions per minute (RPM), is denoted by an arrow 19. Each connection between the respective pistons 16 and rods 18, and between the rods and crankshaft 14, includes an appropriate bearing (not shown) for smooth and reliable rotation.

Engine 10 also includes an oil pan or sump 20. Sump 20 is arranged on engine 10 and is attached to block 12 for holding a body of oil 22. Body of oil 22 is employed within engine 10 for lubricating engine's moving parts, such as bearings (not shown), pistons 16 and rods 18, and for other functions such as cooling the engine by carrying heat generated by friction and combustion away from the moving parts. Body of oil 22 additionally functions to remove contaminants from engine 10. Engine 10 additionally includes an oil filter 26 specifically configured to trap various foreign particles that the oil may collect while in service. In order to not restrict oil flow, filter 26 is generally capable of trapping particles down to only a certain size, and may thus fail to capture smaller contaminants. The body of oil 22 may also absorb soluble contaminants that are not removed by filter 26. Therefore, over time, body of oil 22 becomes chemically degraded due to oxidation and nitration, as well as contaminated with foreign materials, thus becoming less effective in its protection of engine 10, and necessitating the oil to be changed. Sump 20 includes a removable plug 24, which may be configured as a threadable fastener, for permitting body of oil 22 to be drained from the sump during an oil change.

Automatic oil life system 5 also includes a controller 28, and may include a sensor 30, as shown. Controller 28 may be a central processor configured to regulate operation of engine 10 or a dedicated unit programmed to solely operate the automatic oil life system. Sensor 30 is configured to sense a level or height of the body of oil 22. Controller 28 is in communication with sensor 30, which is arranged on the engine 10 relative to the sump 20. Sensor 30 is at least partially immersed in body of oil 22 and is configured to sense level of the oil present in sump 20, and communicate such data to controller 28. Sensor 30 may be configured to sense the level of body of oil 22 either while engine 10 is shut-off, or dynamically, i.e., while the engine is running. Controller 28 receives data from the sensor 30 and determines an appropriate time or instance for body of oil 22 to be changed, i.e., replaced with fresh oil.

The appropriate allowed number of engine revolutions before changing body of oil 22 is determined according to a mathematical relationship or algorithm $R(Rev)=K(Oil)\times[K(Eng)\times K_{BD}]\times V$, which is denoted by numeral 33. Mathematical relationship 33 is programmed and stored in the controller 28. R(Rev) represents a total number of engine revolutions permitted on a specific volume of the body of oil 22. R(Rev) may also be representative of a predetermined level of effective or useful life remaining in the body of oil 22 prior to necessitating an oil change. The factor K(Oil) represents a total number of allowed combustion events of engine 10 per liter of the body of oil 22, while K(Eng) represents a number of revolutions of engine 10 for each combustion event of the engine. $K_{BD}$ represents a factor that accounts for the actual size of combustion chambers 17 in engine 10, and V represents a volume in liters of the body of oil 22 present in sump 20. Total number of allowed combustion events per liter of the body of oil 22, K(Oil), is an input variable in relationship 33.

K(Eng) is a mathematical constant, the value of which depends on the actual engine configuration, with a specific number of cylinders. For example, in a six-cylinder, four-stroke engine, two complete engine revolutions are required for each cylinder to experiences a single combustion event, i.e., K(Eng) is equal to 2 divided by 6 in the same example, and is therefore equal to a value of ⅓. The highest temperatures seen by the engine 10 occur within combustion chambers 17 during actual combustion events. Temperatures seen by components immediately near combustion chambers 17, such as sections of block 12 surrounding the combustion chambers, are somewhat lower than those within combustion chambers 17 themselves, but are still elevated significantly compared to other areas of the engine, especially compared with the temperatures seen in sump 20. Such elevated temperatures impose a harsh environment on the particular portion or volume of the body of oil 22 that is circulated through engine 10 in the immediate vicinity of the combustion chambers 17. Accordingly, exposure of oil to such elevated temperatures accelerates degradation of the particular portion of the body of oil 22, and leads to a reduction in the total number of permitted engine revolutions R(Rev).

The particular portion of the body of oil 22 that is exposed to the elevated temperatures near combustion chamber 17 is directly related to a bore diameter 21 of the combustion chamber. Factor $K_{BD}$ is set to 100 divided by the bore diameter 21, wherein the bore diameter is specified in millimeters, and thus accounts for the effect of the exposure of the particular volume of oil to elevated temperatures surrounding combustion chambers 17. Therefore, in the example of the six-cylinder four-stroke engine described above, K(Eng) value of ⅓ is additionally multiplied by the factor $K_{BD}$, i.e., the product of 100 divided by the bore diameter 21. The result of $K(Eng)\times K_{BD}$ is then employed in the mathematical relationship 33. Within the same mathematical relationship 33, factor V is a volume in liters of the body of oil 22 determined by the rated oil capacity of engine 10, which is typically indicated at the "full" mark on an oil level indicator or dipstick (not shown), or based on the oil level in sump 20 sensed by sensor 30 after the oil change. As such, when the mathematical relationship 33 incorporates factor $K_{BD}$, R(Rev) is thereby adjusted for the volume of oil exposed to each combustion event taking place in the combustion chambers 17 of engine 10.

Subsequent to the determination of R(Rev) based on relationship 33, controller 28 executes a control action, such as activating or triggering an oil life indicator 34. Oil life indicator 34 is configured to signal to an operator of the engine or of the host vehicle when the number of engine revolutions permitted on the determined quality and volume of the body of oil 22, R(Rev) has been reached. The oil life indicator 34 may also display the percentage of oil life remaining. In order to assure that the operator is reliably notified when the time for oil change has arrived, oil life indicator 34 may be positioned on an instrument panel, inside the vehicle's passenger compartment. Oil life indicator 34 may be triggered immediately upon the determination that R(Rev) has been reached, or solely after R(Rev) has been reached when the engine is started and/or shut off. After the number of engine revolutions R(Rev) has been reached and following the oil change, oil life indicator 34 is reset to represent 100% oil life remaining, and the determination of R(Rev) on a fresh body of oil may commence.

Figure 2:
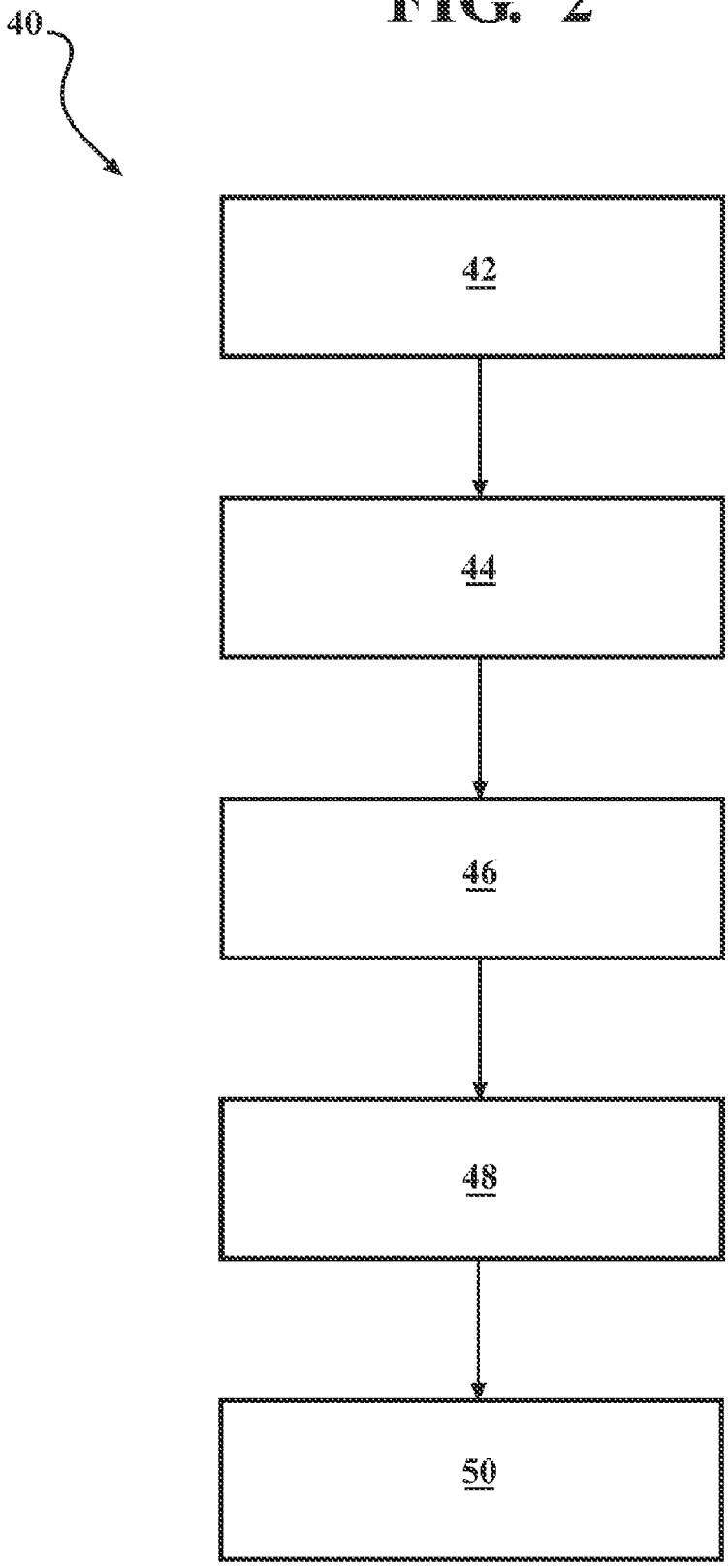
FIG. 2 is a flow chart illustrating a method for determining a number of engine revolutions permitted on a volume of oil in an internal combustion engine.

A method 40 for determining remaining oil life prior to an oil change is shown in FIG. 2, and described below with reference to the structure shown in FIG. 1. Method 40 commences in frame 42 with transferring body of oil 22 to sump 20. Following frame 42, the method proceeds to frame 44, where it includes determining volume of oil V of the transferred body of oil 22, as described above with respect to FIG. 1. After frame 44, the method advances to frame 46, where it includes determining factor $K_{BD}$ which represents a volume of oil from the body of oil 22 that is exposed to a combustion event in engine 10.

Following frame 46, the method proceeds to frame 48. In frame 48, the method includes determining when the remaining oil life reaches a predetermined level, and an oil change is required. The predetermined level of remaining oil life may be established according to the number of engine revolutions R(Rev), wherein R(Rev) is based on the determined factor $K_{BD}$ and the determined volume of the body of oil 22 by using the relationship 33. Following frame 48, the method advances to frame 50, where it includes executing a control action, such as activating the oil life indicator 34, to signal to an operator of engine 10 or of the vehicle where the engine resides when the remaining oil life reaches the predetermined level. A continuous reading of the percentage of remaining useful oil life as reflected by the number of engine revolutions R(Rev)

adjusted for volume of oil exposed to a combustion event based on the factor $K_{BD}$ may also be provided.

While the best modes for carrying out the invention have been described in detail, those familiar with the art to which this invention relates will recognize various alternative designs and embodiments for practicing the invention within the scope of the appended claims.

The invention claimed is:

1. A method for determining remaining oil life prior to an oil change in an internal combustion engine that uses a body of oil, the method comprising:

transferring the body of oil to the engine, wherein the engine includes a combustion chamber defined by a bore diameter;

determining a volume of the transferred body of oil;

determining, based on the bore diameter, a factor representative of a volume of oil from the transferred body of oil that is exposed to a combustion event in the engine;

determining, according to a mathematical relationship, the remaining oil life based on the determined volume of the body of oil and the determined factor representative of a volume of oil that is exposed to a combustion event; and activating an oil change indicator when the remaining oil life reaches a predetermined level;

wherein said determining a volume of the transferred body of oil, said determining the remaining oil life, and said activating the oil change indicator is automatically accomplished via a controller operatively connected to the engine.

2. The method of claim 1, further comprising resetting the oil change indicator to represent 100% of oil life remaining following the oil change.

3. The method of claim 2, wherein said resetting the oil change indicator is accomplished via the controller

4. The method of claim 1, wherein the engine includes an oil sump arranged to accept the transferred body of oil, and said determining the volume of the transferred body of oil includes determining a level of the transferred body of oil in the sump.

5. The method of claim 1, wherein said determining the remaining oil life includes determining a number of revolutions for each combustion event of the engine, and further includes determining a total number of combustion events permitted using the determined volume of oil.

6. A system for determining remaining oil life permitted prior to an oil change in an internal combustion engine that uses a body of oil, the system comprising:

an oil sump arranged on the engine to accept the body of oil;

a sensor arranged on the engine and configured to provide a signal indicative of a volume of the body of oil in the sump; and a controller operatively connected to the sensor and programmed to automatically determine the permitted remaining oil life based on the determined volume of the body of oil and a determined factor representative of a volume of oil that is exposed to a combustion event;

wherein the engine includes a combustion chamber defined by a bore diameter, and the factor representative of a volume of oil from the transferred body of oil that is exposed to a combustion event is based on the bore diameter.

7. The system of claim 6, further comprising an oil change indicator, wherein the controller is configured to activate the oil change indicator when the remaining oil life reaches a predetermined level.

8. The system of claim 7, wherein the oil change indicator is reset to represent 100% of oil life remaining following the oil change.

9. The system of claim 6, wherein the controller is programmed with a number of revolutions for each combustion event of the engine, and the controller additionally determines the remaining oil life based on the total number of revolutions for each combustion event of the engine.

10. The system of claim 6, wherein the signal indicative of a volume of the body of oil is indicative of a level of the body of oil in the sump, and the controller determines the volume based on the level.

11. The system of claim 6, wherein the controller is programmed with a number of combustion events permitted per the volume of the body of oil in the sump, and the controller additionally determines the remaining oil life based on the total number of combustion events.

12. A method for determining a number of engine revolutions permitted prior to an oil change in an internal combustion engine that uses a body of oil, the method comprising:

transferring the body of oil to the engine, wherein the engine includes a combustion chamber defined by a bore diameter;

determining a volume of the transferred body of oil;

determining, based on the bore diameter, a factor representative of a volume of oil from the transferred body of oil that is exposed to a combustion event in the engine;

determining, according to a mathematical relationship, the remaining oil life based on the determined volume of the body of oil and the determined factor representative of a volume of oil that is exposed to a combustion event; and activating an oil change indicator when the total number of engine revolutions reaches a predetermined level;

wherein said determining a volume of the transferred body of oil, said determining the remaining oil life, and said activating the oil change indicator is accomplished automatically via a controller operatively connected to the engine.

13. The method of claim 12, further comprising resetting the oil change indicator to represent 100% of oil life remaining following the oil change.

14. The method of claim 13, wherein said resetting the oil change indicator is accomplished via the controller.

15. The method of claim 12, wherein the engine includes an oil sump arranged to accept the transferred body of oil, and said determining the volume of the transferred body of oil includes determining a level of the transferred body of oil in the sump.

16. The method of claim 12, wherein said determining the total number of engine revolutions includes determining a number of revolutions for each combustion event of the engine, and further includes determining a total number of combustion events permitted using the determined volume of oil.

* * * * *